US009297622B2

(12) United States Patent
Roy

(10) Patent No.: US 9,297,622 B2
(45) Date of Patent: Mar. 29, 2016

(54) PROJECTILE WITH STEERABLE FINS AND CONTROL METHOD OF THE FINS OF SUCH A PROJECTILE

(71) Applicant: NEXTER MUNITIONS, Versailles (FR)

(72) Inventor: Richard Roy, Bourges (FR)

(73) Assignee: NEXTER MUNITIONS, Versailles (FR)

( * ) Notice: Subject to any disclaimer, the term of this patent is extended or adjusted under 35 U.S.C. 154(b) by 219 days.

(21) Appl. No.: 14/013,791

(22) Filed: Aug. 29, 2013

(65) Prior Publication Data

US 2014/0061365 A1 Mar. 6, 2014

(30) Foreign Application Priority Data

Aug. 31, 2012 (FR) ..... 12 02359

(51) Int. Cl.
*F42B 10/64* (2006.01)

(52) U.S. Cl.
CPC ..... *F42B 10/64* (2013.01)

(58) Field of Classification Search
CPC ..... F42B 10/60; F42B 10/62; F42B 10/64; F42B 19/01; F42B 19/06
USPC ..... 244/3.24, 3.28
See application file for complete search history.

(56) References Cited

U.S. PATENT DOCUMENTS 2,654,334 A * 10/1953 Wheeler ..... 114/23
2,851,982 A * 9/1958 Fogarty ..... 114/23
3,067,681 A * 12/1962 Beman ..... 244/3.19
3,154,015 A * 10/1964 Muller ..... 244/3.21
4,327,886 A * 5/1982 Bell et al. ..... 244/3.29
4,588,146 A * 5/1986 Schaeffel et al. ..... 244/3.27
5,950,963 A 9/1999 Speicher et al.
6,247,666 B1 * 6/2001 Baker et al. ..... 244/3.21
7,175,131 B2 2/2007 Dodu et al.
7,246,539 B2 * 7/2007 Turner ..... 74/665 N
7,923,671 B1 * 4/2011 Huguenin et al. ..... 244/3.24

(Continued)

FOREIGN PATENT DOCUMENTS

DE 694 533 8/1940
DE 37 17 688 C1 6/1988

(Continued)

OTHER PUBLICATIONS

Search Report issued in French Application No. 1202359 dated Jun. 4, 2013 (with translation).

*Primary Examiner* — Brian M O'Hara
*Assistant Examiner* — Christopher Hutchens
(74) *Attorney, Agent, or Firm* — Oliff PLC

(57) ABSTRACT

The invention relates to a steering method of a projectile and to the associated projectile with incidence steerable fins, comprising at least three fins, each being pivotable with respect to the projectile around a pivot axis perpendicular to the longitudinal axis X of the projectile, wherein the projectile comprises a fin orientation ring, the ring comprising as many arms as there are fins, wherein the ring can translate in a plan P perpendicular to the longitudinal axis X of the projectile and following at least two directions of this plan P, wherein the orientation ring can rotate on itself around its center parallel to the longitudinal axis X of the projectile, each arm comprising means cooperating with an orientation lever fixed to a fin to be able to pivot the fin around its pivot axis during translation of the ring by positioning means.

3 Claims, 13 Drawing Sheets

(56) References Cited

U.S. PATENT DOCUMENTS

| | | | | |
|---|---|---|---|---|
| 2009/0114763 | A1* | 5/2009 | Geck et al. | 244/3.24 |
| 2011/0180655 | A1* | 7/2011 | Deschatre | 244/3.28 |
| 2012/0175459 | A1* | 7/2012 | Geswender et al. | 244/3.24 |

FOREIGN PATENT DOCUMENTS

| | | | |
|---|---|---|---|
| EP | 1 550 837 | A1 | 7/2005 |
| FR | 2 955 653 | A1 | 7/2011 |

* cited by examiner

PROJECTILE WITH STEERABLE FINS AND CONTROL METHOD OF THE FINS OF SUCH A PROJECTILE

CROSS REFERENCE TO RELATED APPLICATIONS

Applicant claims priority under 35 U.S.C. 119 of French patent application no. 1202359 filed on Aug. 31, 2012.

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC

Not Applicable

BACKGROUND OF THE INVENTION

The invention relates to the technical field of projectiles guided by incidence steerable fins.

To guide a projectile up to its target, it is known to use fins arranged on the periphery of the projectile, either at the empennage or in front position (fins known as foreplane or canard fins). The incidence of the fins is adapted while airborne according to the trajectory wished for the projectile. The incidence steering is most often performed by electrical motors. The U.S. Pat. No. 7,246,539 discloses a steering device of fins of a projectile comprising four fins as well as gear trains associated with motors enabling to set the incidence of the fins.

This type of device requires to know the exact angular position, both for incidence and rolling, of each fin to have it adopt the suitable position to make the projectile follow the desired trajectory. The projectile undergoing a rolling which can be very important, particularly if it is fired from a rifled canon weapon, it is thus necessary to perform continuous corrections on the incidence of the fins.

These corrections have to be performed very quickly, requiring fast calculating means and fast movements of the fins. This generates current peaks, causes a control in fits and starts of motors and causes the generation of intense and irregular magnetic fields from motors. These fields affect projectile guiding means such as homing devices or other sensing devices. Furthermore, the solution suggested by U.S. Pat. No. 7,246,539 is complex in terms of number of gear trains and movement transmission parts.

BRIEF SUMMARY OF THE INVENTION

Thus, the invention suggests to solve the problem of the setting complexity of the fin incidence according to their angular position around the projectile.

The invention also allows to reduce the numerous and violent forces applied to motors.

The invention therefore relates to a projectile with incidence steerable fins, comprising at least three fins, each being pivotable with respect to the projectile around a pivot axis perpendicular to the longitudinal axis of the projectile, wherein the projectile comprises a fin orientation ring, wherein the ring comprises as many arms as there are fins, wherein the ring can translate in a plan perpendicular to the longitudinal axis of the projectile and following at least two directions of this plan, wherein the orientation ring can rotate on itself around its centre parallel to the longitudinal axis of the projectile, each arm comprising means cooperating with an orientation lever fixed to a fin to be able to pivot the fin around its pivot axis during movement of the ring, the translation of the ring being ensured by positioning means of the ring centre in the plan in relation to an absolute frame centered on the longitudinal axis of the projectile.

According to a first embodiment, the positioning means comprises a disk positioned in a central bore of the ring and comprising an circular opening off-centered with respect to the disk centre so as to move the ring centre by rotation of the disk.

Advantageously, the positioning means of the ring centre in both directions of the plan P comprises a cam cooperating with the off-centered circular opening of the disk, this off-centered circular opening comprising an inner toothed ring gear meshing with a pinion centered on the longitudinal axis of the projectile, the combined rotations of the pinion and of the cam enabling the movement of the disk.

According to a second embodiment, the positioning means comprises a disk positioned in a central bore of the ring and comprising a slide linkage oriented parallel to a diameter of the disk and intended to allow the radial movement of the disk in relation to a plate coaxial with the rolling axis, the disk comprising a rack parallel to the slide, wherein the rack meshes with a pinion borne by a secondary shaft coaxial with the rolling axis.

The invention also relates to a control method of fins of a projectile for orientating the projectile according to a given direction D transverse to the projectile, wherein a first embodiment of the method comprises successively the following steps:

- rotating the positioning means in the direction opposite to the rolling of the projectile so as to compensate the rotation of the projectile,
- pivoting the cam and the disk so that their respective maximum off-centering points are diametrically opposite and the alignment A formed by these points is perpendicular to the intended direction,
- pivoting simultaneously and in opposite directions the disk and the cam by a same angular value so as to bring each of the off-centering points closer to the intended direction, thereby moving the ring centre in the desired direction and according to a desired movement amplitude.

According to another embodiment of the invention, the orientation method of the projectile according to a given direction D transverse to the projectile comprises successively the following steps:

- rotating the positioning means in a direction opposite to the rolling of the projectile so as to compensate the rotation of the projectile,
- pivoting the plate by an angle $\Phi$ so that the slide is parallel to the given direction D, while compensating the rotation of the projectile and rotating the secondary shaft simultaneously by a same angular value and in the same direction to maintain the disk centered on the rolling axis X,
- sliding the disk in the given direction D by rotation of the secondary shaft until the off-centering E between the disk centre and the rolling axis X provides the desired correction amplitude.

BRIEF DESCRIPTION OF THE SEVERAL VIEWS OF THE DRAWING

The invention will be better understood upon reading the following description, with reference to the accompanying drawings, in which.

DETAILED DESCRIPTION OF THE INVENTION

Figure 1:
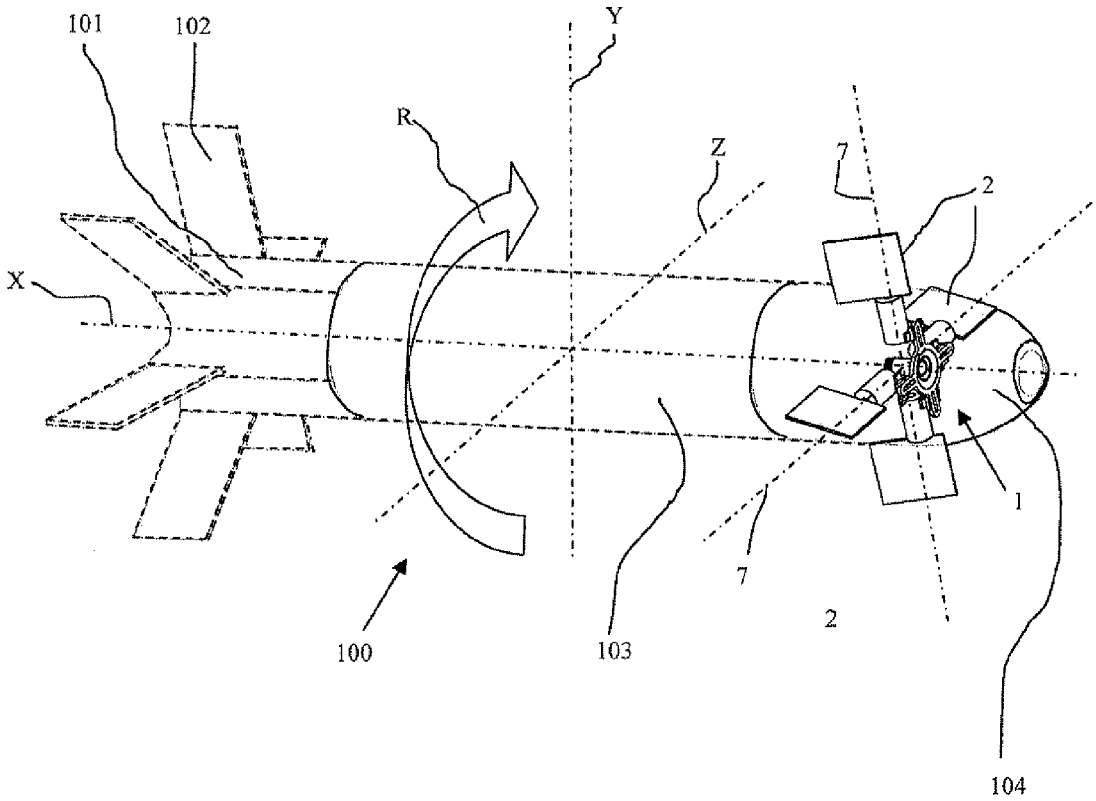
FIG. 1 shows an airborne projectile according to the invention.

According to FIG. 1, an airborne projectile 100 comprises a substantially cylindrical body 103. This projectile 100 comprises at the rear part thereof an empennage 101 which comprises itself fixed incidence ailerons 102, for stabilizing the projectile 100 according to its pitch Y and yaw Z axes. The projectile has a rotation movement R around its longitudinal axis, referred to as rolling axis X.

Fins 2 are provided at the front part of the projectile 100, which fins 2 are fixed to the projectile and each being pivotable on a fin axis perpendicularly to the rolling axis so as to modify their incidence and, consequently, to make the projectile 100 follow a desired trajectory. The fins 2 being fixed to the projectile 100 also have the same rotation movement R around the rolling axis as the projectile 100.

A warhead 104 is located at the front part of the projectile 100, close to the fins 2, the warhead 104 housing a steering device 1 for orientating the incidence of the fins 2 of the projectile 100 following a guiding law programmed in a homing device (not shown).

Figure 2:
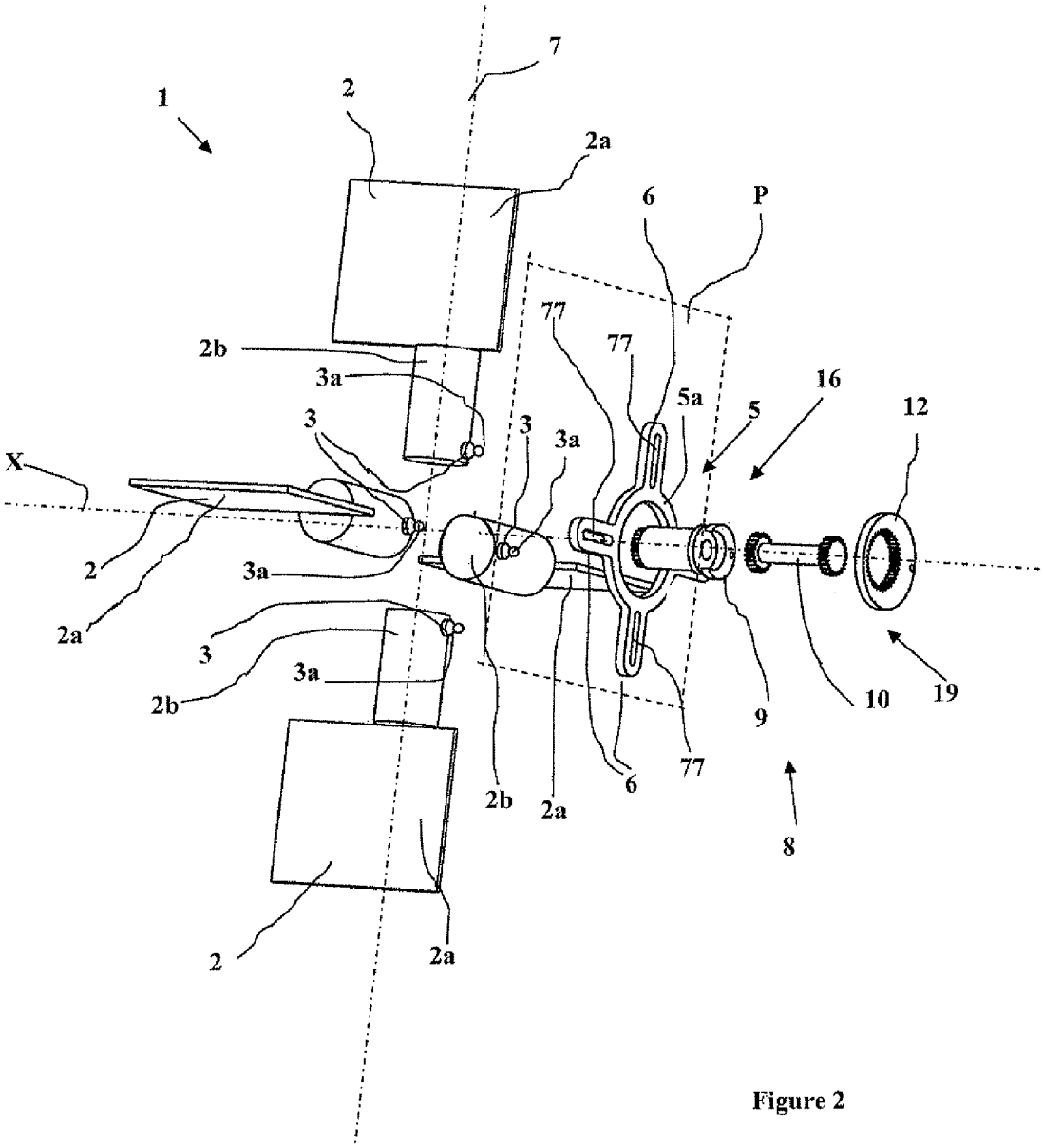
FIG. 2 shows an exploded view of a control device according to the invention.

According to FIG. 2, the steering device 1 comprises the following elements; fins 2 fixed to the projectile, incidence of which is steerable by pivoting around axes 7 perpendicular to the rolling longitudinal axis X.

The fins 2 are shown in their deployed position. Each fin 2 comprises a directing plan 2*a* whose base is integral with a fin foot 2*b* pivotally mounted with respect to the projectile body. Each directing plan 2*a* is adapted to influence, by pivoting around the axis 7, the negative lift of the projectile to modify its trajectory. Each fin 2 comprises, perpendicularly to its pivot axis 7, a lever 3 fixed to the fin foot 2*b* of the fin 2. The free end 3*a* of the lever 3 facing the forward part of the projectile has a spherical shape. The fin foot 2*b* may comprise or be associated with deployment means not shown (such as described for example in the French patent FR2955653 or in the European patent EP1550837).

The steering device comprises a ring 5 referred to as fin orientation ring. This ring 5 comprises an annular part 5*a* and as many arms 6 as the projectile comprises fins 2. Each arm 6 is fixed to the annular part 5*a* and extends radially from the annular part 5*a*. The orientation ring 5 and each arm are located in a plan P perpendicular to the rolling axis X of the projectile. The ring 5 is maintained in its plan P by guiding means not shown, for example between two fixed plates fixed to the projectile body.

Each arm 6 of the ring 5 comprises a longitudinal groove 77 for receiving the spherical end 3*a* of the levers 3. The groove 77 allows the sphere 3 to slide in the longitudinal direction of the groove 77 and in the thickness direction of the arm 6.

Figure 3:
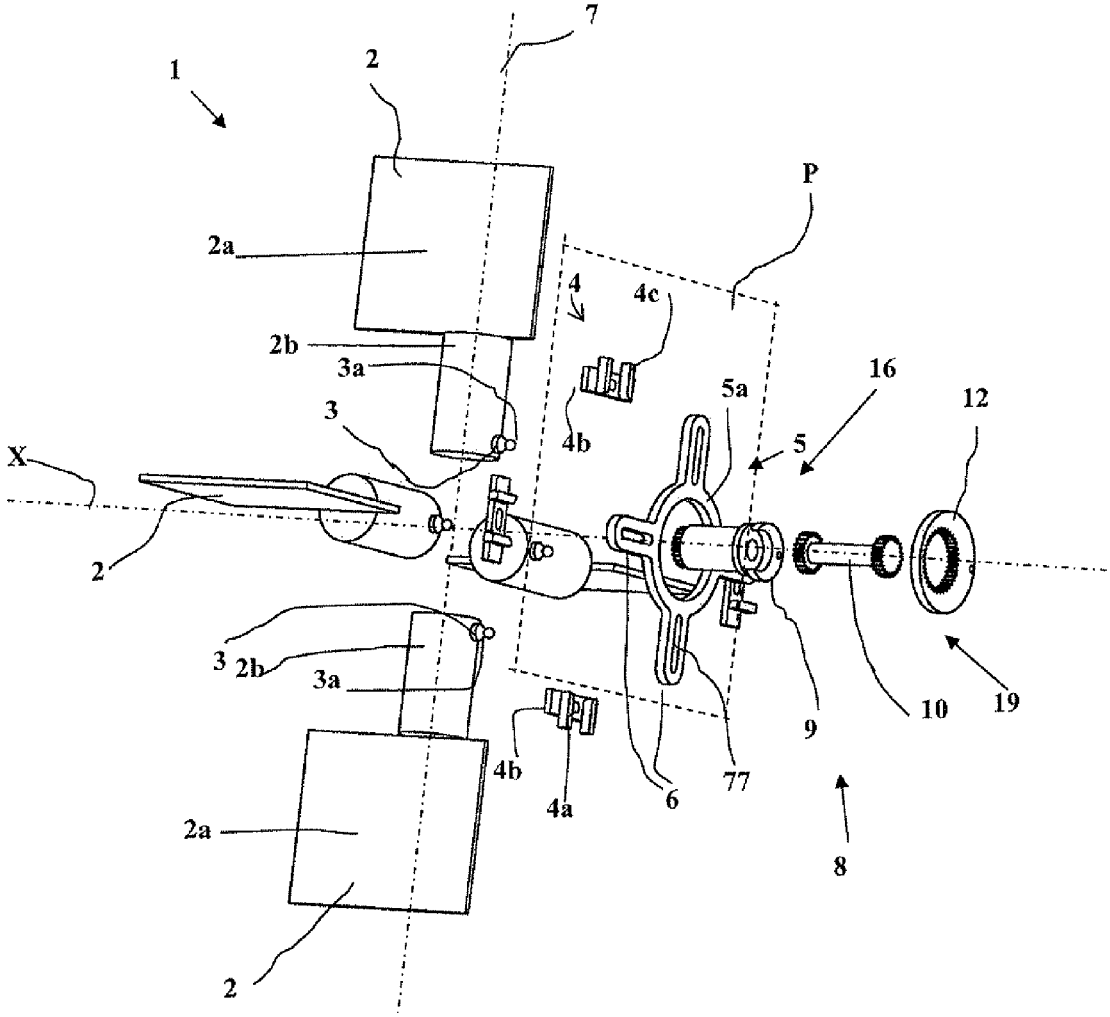
FIG. 3 shows an exploded view of a control device according to an alternate embodiment of the invention.

According to an alternate embodiment depicted in FIG. 3, each sphere 3*a* is adapted to correspond to an opening 4*a* of a carriage 4. The carriage 4 comprises guiding means 4*b* for cooperating with grooves (not shown) fixed with respect to the projectile body and forming slide linkages orthogonal to the rolling axis X of the projectile.

Thus, the first guiding means comprises a prismatic bar 4*b* for matching with a groove of the projectile body 100 (groove not shown). The bar 4*b* can freely slide in the groove, perpendicularly to the pivot axis 7 of the fin and parallel to the plan P of the ring 5.

The second guiding means 4*c* is integral with the first guiding means 4*b* and comprises a pair of rails 4*c* oriented parallel to the pivot axis 7 of the fin 2 and guiding an arm 6 of the ring 5. Each carriage 4 is adapted to facilitate movements of the sphere 3*a* of the lever 3 with respect to the arms 6. In particular, it enables the spherical end to slide with a greater amplitude in the thickness direction of the arm 6.

The ring 5 can be translated in all directions of the plan P (see FIG. 2) perpendicularly to the rolling axis X.

Figure 4:
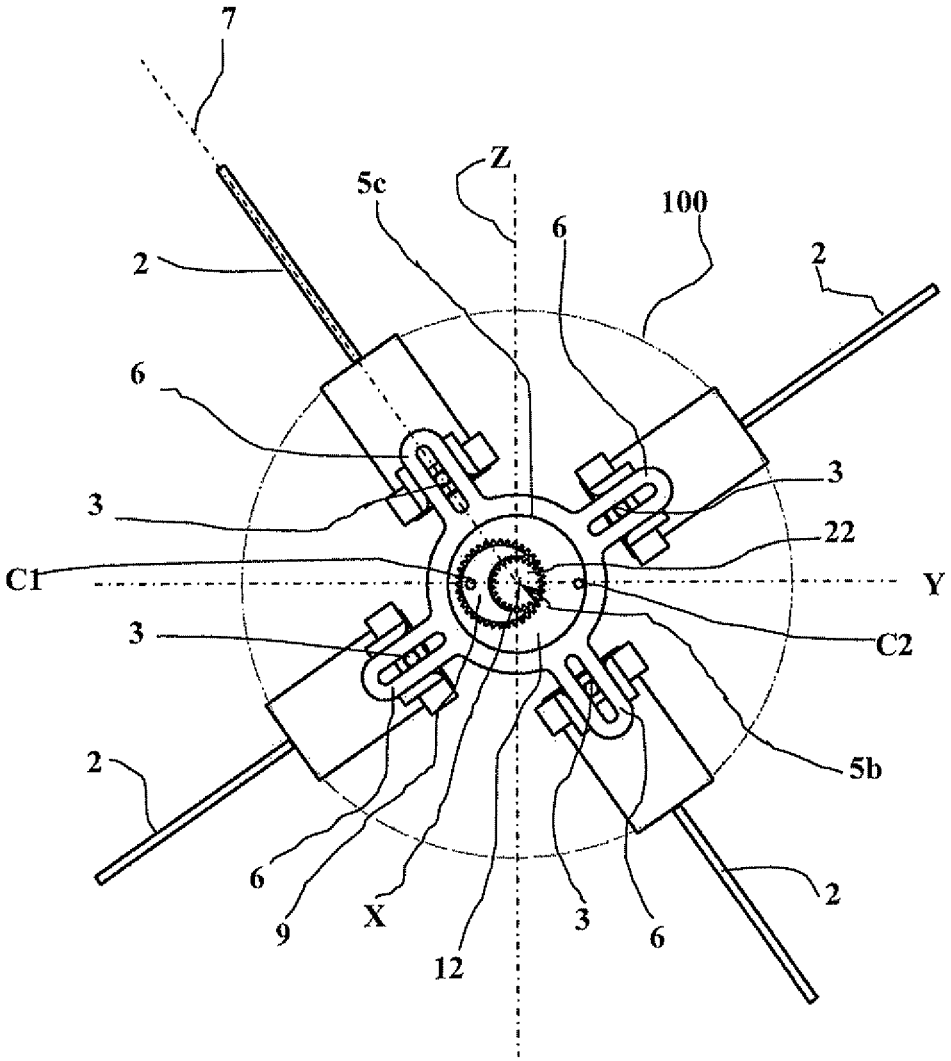
FIG. 4 shows a cross-section view of a control device according to the invention in a neutral configuration.

FIG. 4 shows the positioning of the ring 5 when the fins 2 are in the neutral position (plan of fins parallel to the rolling axis X). The ring 5 is then coaxial with the rolling axis X. On FIG. 5, this neutral position or initial position of the ring 5 upon shot is represented by dotted lines. The translation in a direction D of the ring 5 from the neutral position to the position of the ring 5 represented by continuous lines leads to a component of stress normal to the arms 6*b* which are perpendicular to the movement D. This component causes the fins 2*b* to pivot via the levers 3 (levers 3 better seen on FIG. 2).

Grooves 77 of the arms 6*a* (FIG. 5) which are oriented parallel to the movement direction D of the ring 5 slide with respect to the levers 3, not causing thereby any pivoting movement of the associated fins 2*a*.

Figure 6:
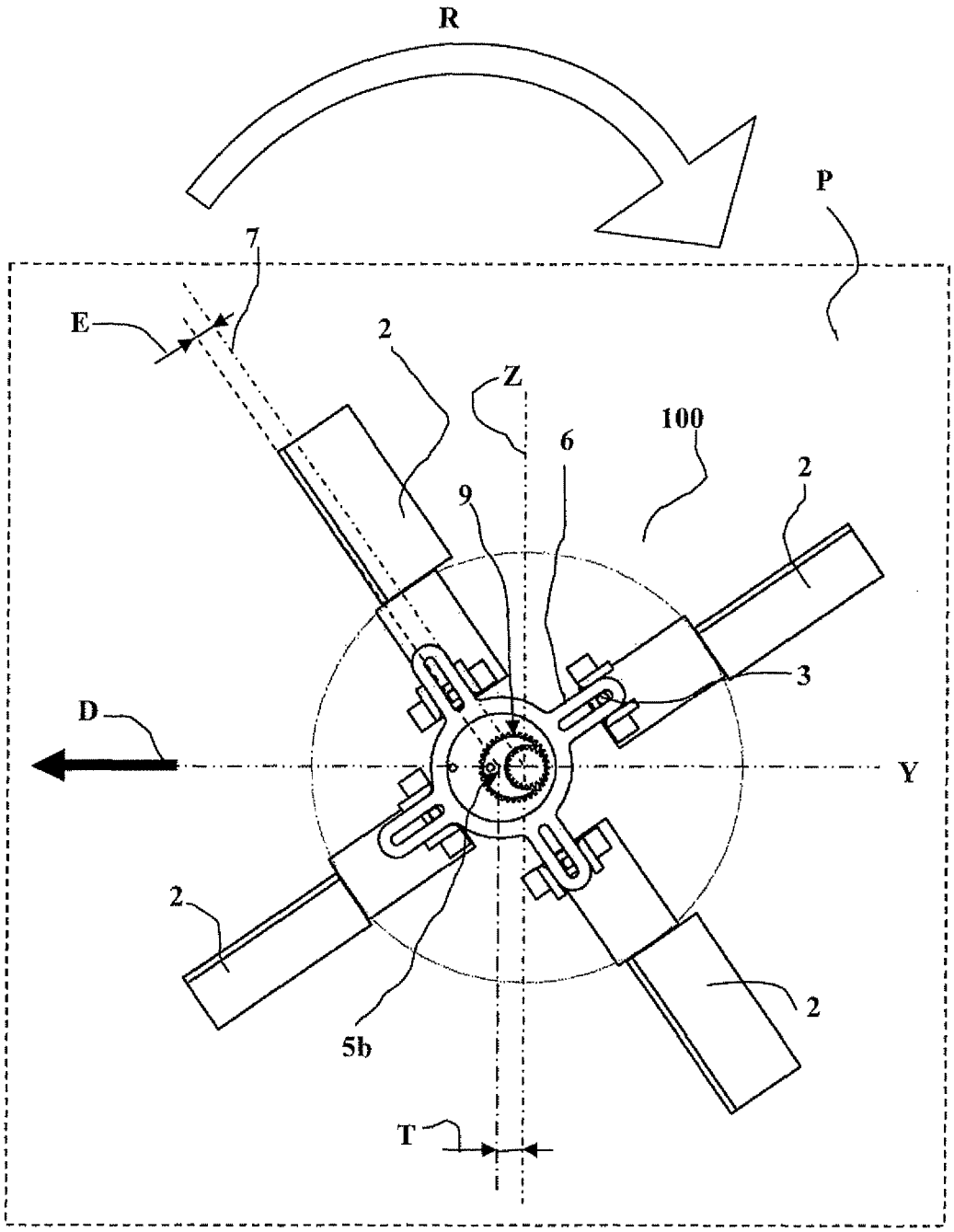
FIG. 6 shows a view similar to FIG. 5 of a different angular position of the projectile.

As can be seen in FIG. 6, the airborne rotation of the projectile around its rolling axis X (or longitudinal axis) leads to the rotation of fins 2 around this axis X. The ring 5 is thus rotated around its own axis by the levers 3 of the fins 2.

Positioning means 8 detailed thereafter enables to modify the position of the centre 5*b* of the ring 5 in the plan P with respect to an absolute frame centered on the axis X (frame provided by a satellite positioning system or GPS or by an embedded inertial navigation system for example).

Thus, an offset between the rotation centre 5*b* of the ring 5 and the longitudinal axis X of the projectile may be obtained. This offset T corresponds to a radial distance between the axis X of the projectile and the centre 5*b* of the ring 5 and is shown in FIG. 6.

As the arms 6 of the ring 5 rotate, when they move closer to the direction D, fins are gradually put to neutral. Conversely, when the arms rotate up to an angle of 90° with respect to the direction D, the fins 2 pivot up to the maximum deflection angle which is directly related to the amplitude of the offset T between the centre 5*b* of the ring 5, in its initial central position, and the current position of the centre of the ring 5.

On FIG. 6, it can be seen that with such a movement of the ring 5 in the direction D, the levers 3 of each fin 2 are or are not driven to pivot by the arm 6 of the ring 5 associated with said lever.

Figure 5:
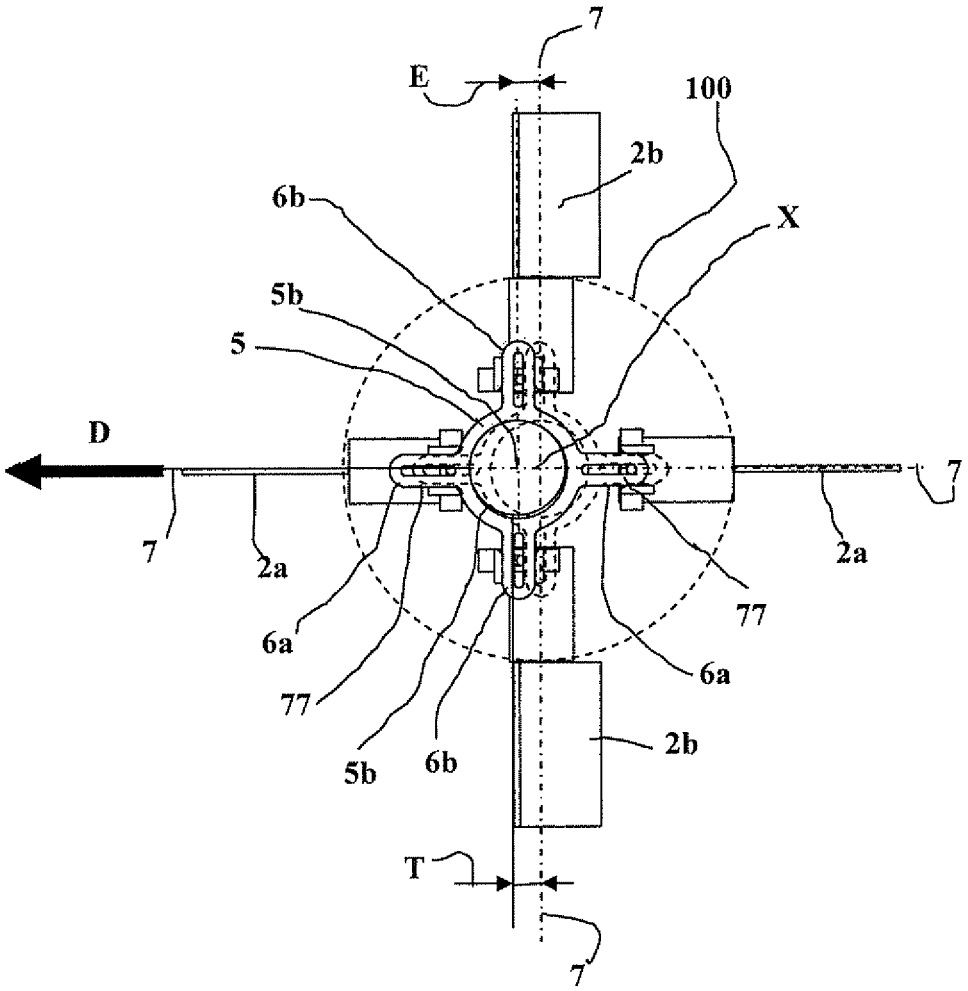
FIG. 5 shows a cross-section view of a control device according to the invention in a configuration of correction of maximum amplitude trajectory (maximum deflection of fins).

Thereby, on FIG. 5, it can be seen that when the rotation axis 7 of a fin 2*a* is aligned with the movement direction D of the ring 5 (direction considered radially from the rolling axis X), this fin 2*a* is not pivoted with respect to its axis 7 (it is at neutral). It is thus the case for both horizontal fins 2*a* on FIG. 5.

Figure 7:
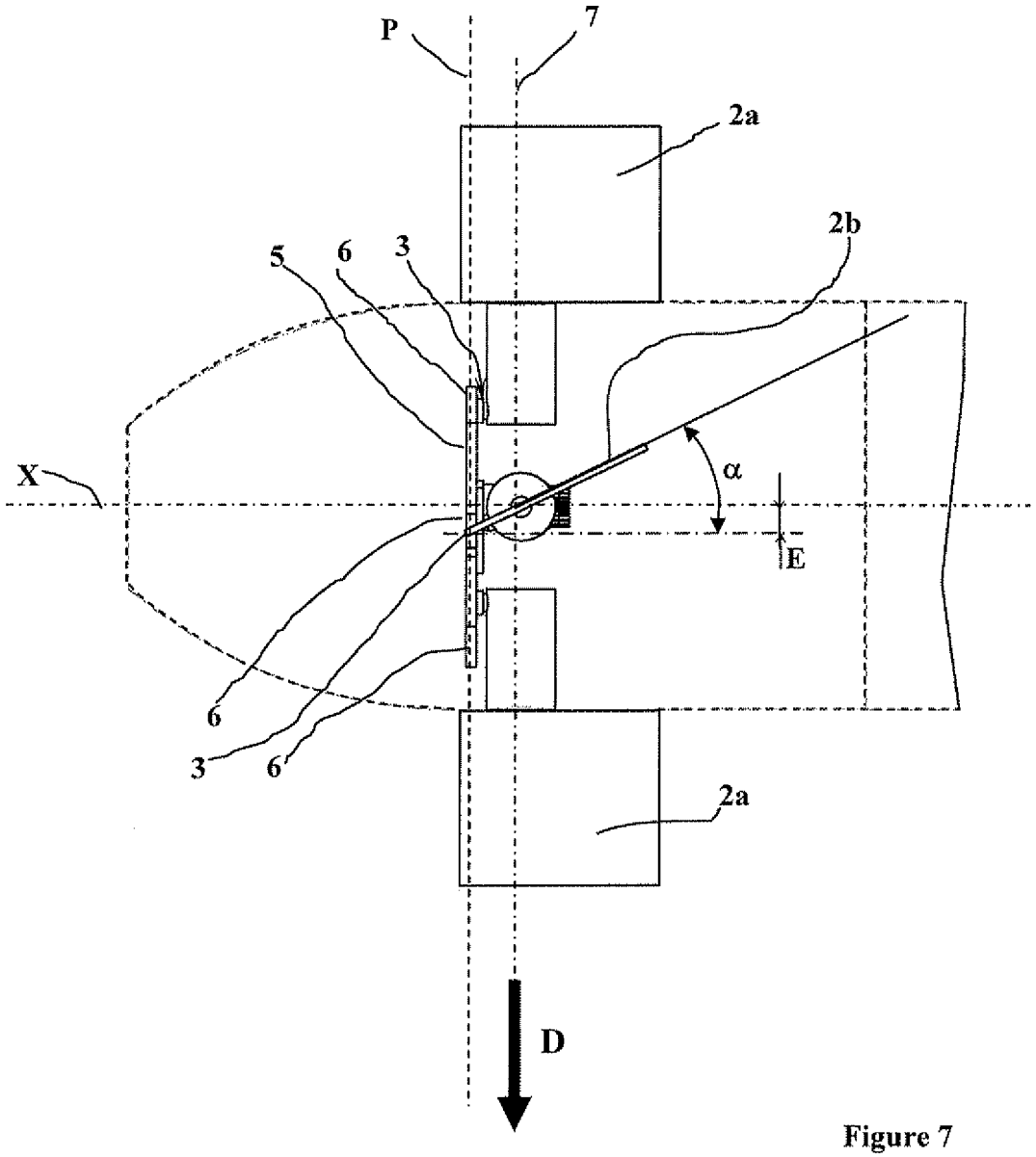
FIG. 7 shows a side view of the control device in a configuration where fins are at maximum deflection.

Conversely, the other two fins 2*b* which are perpendicular to the fins 2*a* have their pivot axis 7 which is offset of a distance E from the direction of the associated arm 6 borne by the ring 5. In the angular position of the fins of FIG. 5, the distance E is equal to the offset T given to the ring 5. This results in the pivoting movement of these fins 2*b* being controlled by the arms 6. The incidence α is maximum for these fins 2*b*, axes of which are perpendicular to the direction D (FIGS. 5, 6, 7).

Therefore, as can be seen in FIGS. 5 and 6, when the fins rotate around the rolling axis X, the more the angle formed by the pivot axis 7 of the fin and the direction D approaches 90°, the more the offset E between the arm 6 of the ring 5 and the pivot axis 7 of the associated fin 2 increases up to the maximum value E=T. Therefore, it causes a rotation of the fin 2 around its pivot axis 7, which provides a non-zero incidence α to the fins 2, as can be seen in FIG. 7. The maximum incidence is obtained for the fin positions with their axis 7 perpendicular to direction D. The incidence decreases when the angle α varies from 90° to 180° and increases again when the angle α varies from 180° to 270°.

By comparing FIG. 5 and FIG. 6, it can be noted that the maximum incidence angle α for a fin 2*b* will be obtained (for a given position of the ring 5) when the angle of 90 degrees between the pivot axis 7 of the fin 2*b* and the direction D will be reached.

Thus, each fin having a rotation movement R around the projectile will cyclically transition from a zero incidence to a maximum incidence, twice consecutively, during a single turn around the projectile 100.

It has been noted that the movement direction D of the ring 5 corresponds to the direction of the correction of the desired trajectory for the projectile.

The more the offset T in FIG. 5 between the centre 5*b* of the ring 5 and the rolling axis X is important, and the more the maximum incidence for each fin 2 during its passage perpendicularly to the direction D is also important (i.e. the more the angle α of FIG. 7 is important).

This device thus enables an easy setting of the correction to be performed on the trajectory of the projectile without requiring the knowledge at any moment of the angular position of each fin with respect to the direction wished for the projectile.

Thus, the orientation of the projectile in a direction D is determined by the vector passing through the centre 5*b* of the ring 5 and the rolling axis X of the projectile.

The amplitude of the radial offset T following this direction D (offset of the centre 5*b* of the ring with respect to the rolling axis X) gives the amplitude of the given correction (value of the deflection angle α given to the fins).

This positioning is obtained as will now be described below using positioning means 8.

According to FIG. 2, the control device 1 comprises positioning means 8 for moving and positioning the centre 5*b* of the ring 5 with an offset T more or less significant with respect to the centre of the projectile X and oriented in the direction wished for the orientation of the projectile.

Figure 8:
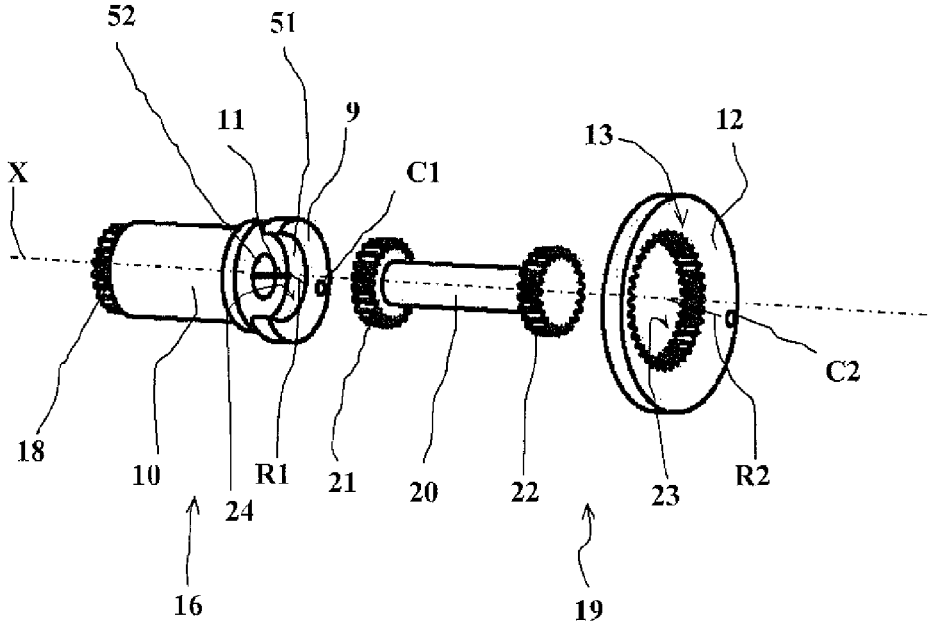
FIG. 8 shows an exploded view of positioning means.
Figure 9:
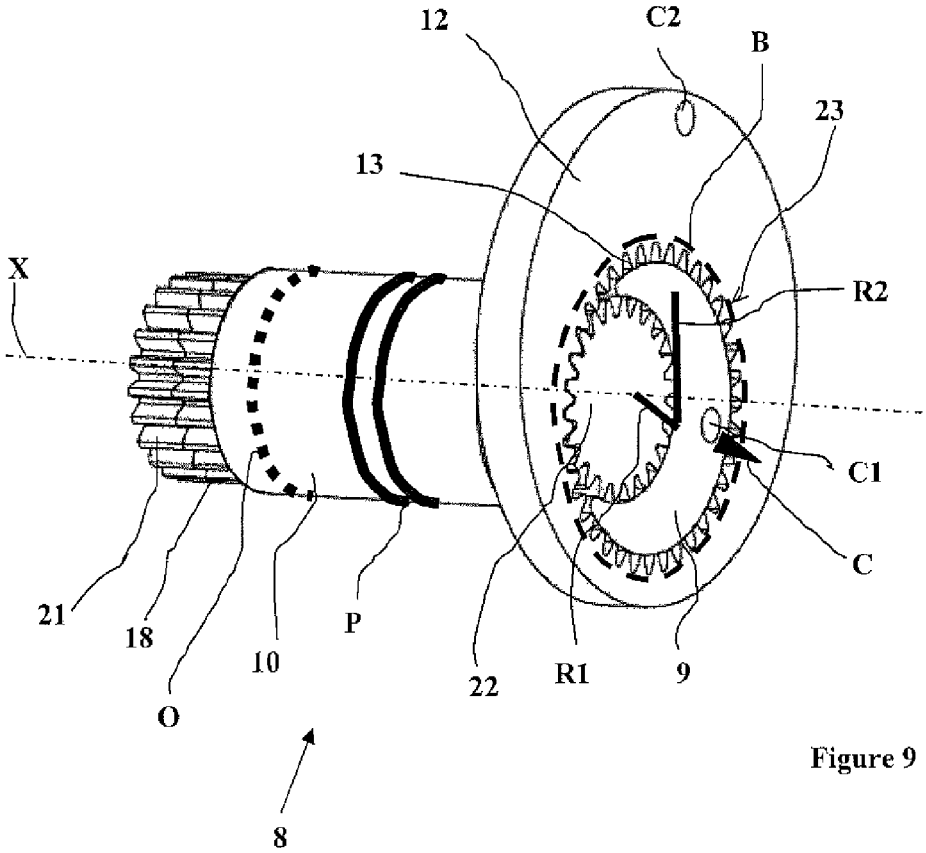
FIG. 9 shows a view of the assembled positioning means.

The positioning means 8 is represented with an exploded view in FIG. 8 and with an assembled view in FIG. 9. It is provided with primary eccentric positioning means 16 and secondary eccentric positioning means 19.

The primary eccentric positioning means 16 comprises a disk portion-shaped cam 9 fixed to a first end of a tubular primary shaft 10 having an axis X, thus coaxial with the projectile. The cam 9 is off-centered by a value R1 with respect to the rolling axis X and comprises a recess 51 with a cylindrical profile of axis X. The second end of the primary shaft 10 comprises external teeth 18 for rotating the primary shaft 10 around the rolling axis X by means of a first motor not shown.

The secondary eccentric positioning means 19 comprises a disk 12 which is provided with a circular opening 13. The circular opening 13 comprises an inner toothed ring gear 23. The circular opening 13 is adapted to receive the cam 9 of the primary positioning means 16 previously described.

The circular opening 13 has its centre coincident with that of the cam 9 and is off-centered with respect to the centre of the disk 12 by a value R2.

The secondary eccentric positioning means 19 comprises a secondary shaft 20 which bears at each of its ends pinions 21 and 22. The secondary shaft 20 is adapted to be adjusted in a bore 52 of the primary shaft 10. One of the pinions 22 is adapted to be arranged in the recess 51 of the cam 9 and its teeth are adapted to match with the toothed ring gear 23 of the disk 12.

The other pinion 21 is arranged in the vicinity of the teeth 18 of the primary shaft 10. This last pinion 21 is adapted to mesh with a second motor (not shown).

FIG. 9 allows to see the positioning means 8 assembled with the primary and secondary positioning means positioned in relation to each other.

Both eccentric positioning means 16 and 19 each comprise a maximum off-centering point. This point is located by a circle C1 on the cam 9 and provides the maximum off-centering of the cam 9 with respect to the rolling axis X. On the disk 12, the circle C2 provides the maximum off-centering point of the disk 12 with respect to the centre of the cam 9.

On FIGS. 4, 5, 6, 9, 10, 12, it can be noted that the inner bore 5*c* of the ring 5 cooperates with the periphery of the disk 12. The ring 5 and the disk 12 are adjusted with respect to each other so as to enable the rotation of the ring 5 by sliding around the disk 12. The centre 5*b* of the ring 5 is coincident with that of the disk 12. Therefore, the ring 5, as well as the disk 12, is off-centered by a value R2 with respect to the centre of the cam 9.

To orientate the projectile, the translation of the ring 5 in the plan P proceeds in three phases from a position referred to as neutral corresponding to the straight flight of the projectile. In such a position shown in FIG. 4, maximum off-centering points C1 and C2 of the cam 9 and of the disk 12 are diametrically opposed with respect to the rolling axis X of the projectile 100, thereby forming an alignment A with the centre of the pinion 22 (centered on the rolling axis X).

In this configuration, the centre 5*b* of the ring 5 is coincident with the rolling axis X. Therefore, the fins are at neutral.

While airborne, the fins (not shown) rotate with the projectile around the longitudinal axis X and cause the rotation of the ring 5. Maintaining this neutral position of the fins is ensured by a driving by the motors of the primary shaft 10 and the secondary shaft 20 so as to continuously compensate the rotation of the projectile. Both primary 10 and secondary 20 shafts thus rotate at the same speed $-\Omega$ which is equal to and opposed to the rotation speed $\Omega$ of the projectile. Therefore, the disk 12 and the cam 9 are fixed in the absolute frame as in FIG. 4 and their position is permanently known by the homing device. In the absence of offset of the centre 5*b* of the ring 5 with respect to the rolling axis X of the projectile, fins are thus maintained at neutral.

Figure 10:
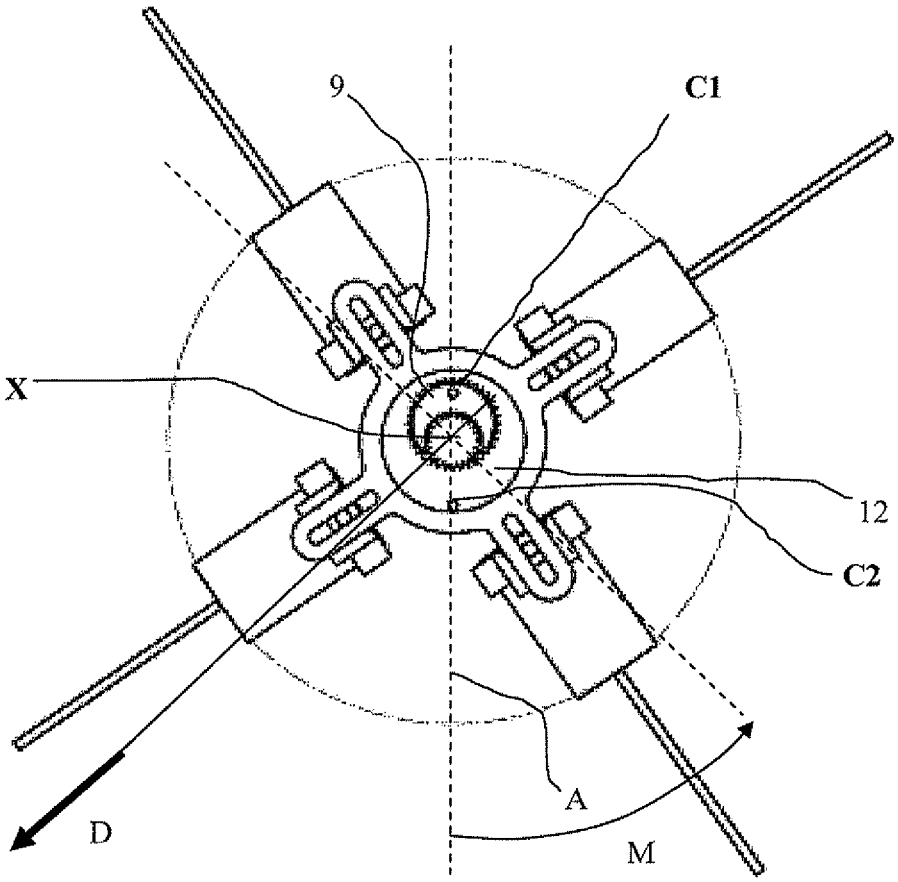
FIG. 10 shows a cross-section view of the projectile during a first steering phase.

In a second phase, illustrated in FIG. 10, a trajectory correction following a direction D must be controlled. Both motors firstly orientate, according to a rotation movement M, the disk 12 and the cam 9 such that the alignment A formed by maximum off-centering points C1 and C2 and the rolling axis X are perpendicular to the intended direction D. This orientation is performed by providing a differential to the rotation speeds of motors with respect to the rotation speed of the projectile on itself. A speed equal to $-\Omega\pm\theta$ shall be given to these motors when a projectile rotates at the speed $\Omega$. This orientation is obtained by simultaneous rotation, in the same direction and at a same angular speed $\pm\theta$ of the disk 12 and the cam 9. The person skilled in the art will select rotation speeds of the motors and their rotation direction according to the gear ratios between the different pinions and ring gears and according to the relative mounting direction of each motor.

Figure 11:
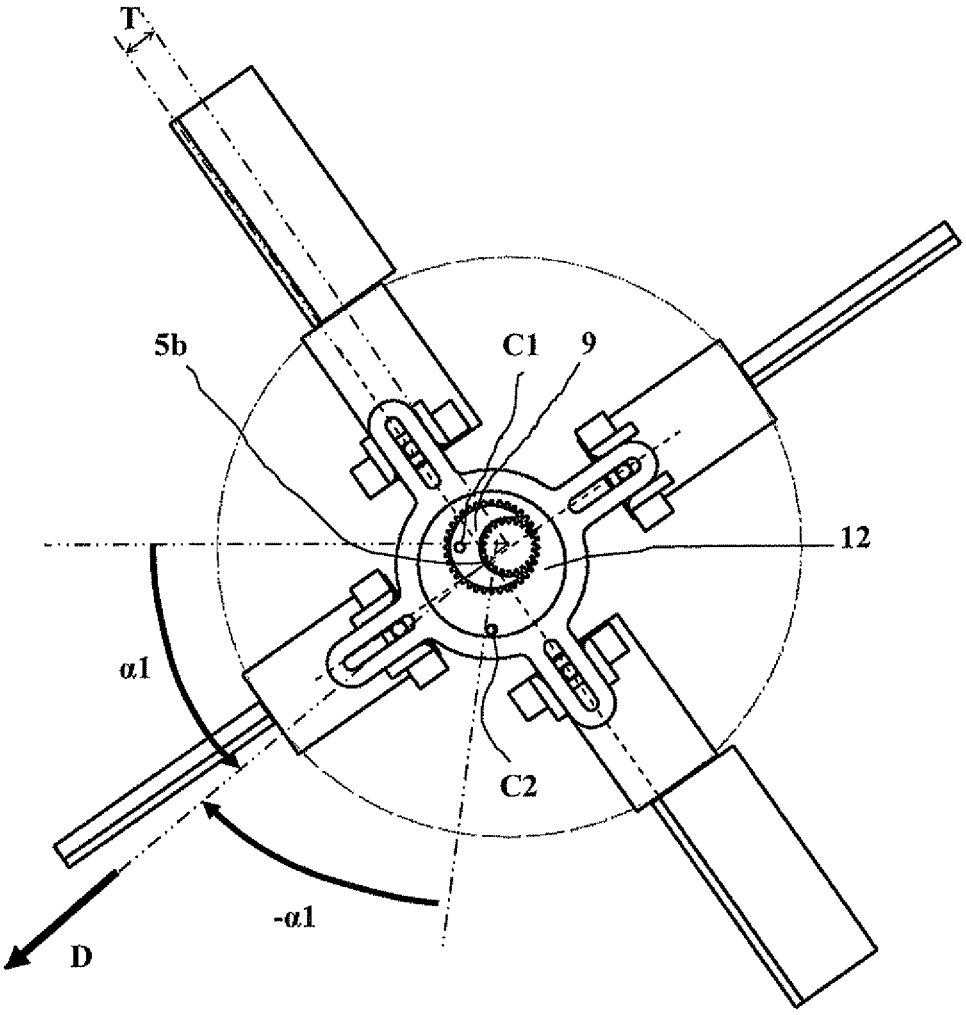
FIG. 11 shows a cross-section view of the projectile during a second steering phase occurring after the phase of FIG. 10.

In a third phase, illustrated in FIG. 11, both motors will rotate so as to move each of the maximum off-centering points C1 and C2 closer to the selected direction D. To this end, the motors are operated simultaneously with identical speeds but in opposite directions so as to orientate the off-centering point C2 of the disk 12 at an angle $\alpha 1$ with respect to the direction D and to orientate the off-centering point C1 of the cam 9 at an angle $-\alpha 1$ with respect to the direction D (see FIGS. 11 and 12). A motor shall be given a speed equal to $-\Omega+b$ while the other motor shall have a speed equal to $-\Omega-b$. $\Omega$ is the absolute value of the instantaneous rotation speed of the projectile and b is an absolute value of a speed subtracted from or added to $\Omega$ to pivot the disk 12 and the cam 9. The person skilled in the art will select the speeds $\theta$ and b as either constant or variable according to the extent of the correction to apply to the trajectory of the projectile.

By doing so, the centre 5*b* of the ring 5 slides in the plan P according to the direction D with an offset T with respect to the rolling axis X.

Figure 12:
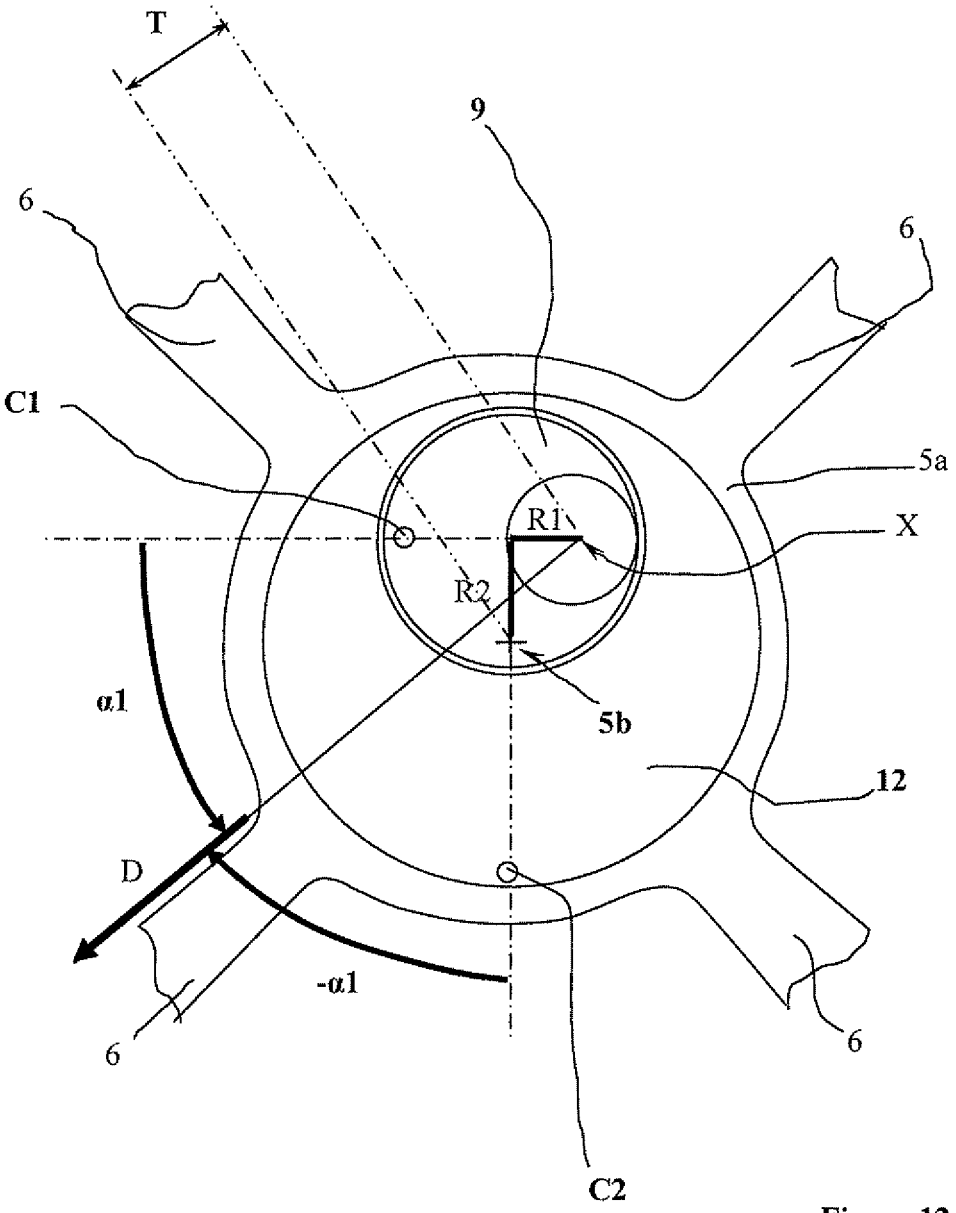
FIG. 12 shows a magnified and simplified detailed view of FIG. 11.

This offset has a value $T=R1 \cos \alpha 1+R2 \cos \alpha 1$ and provides the amplitude of the correction applied along the direction D (FIG. 12).

The important thing is therefore to be able to move the ring 5 in both directions of the plan P by positioning means 8. The use of a motor for each fin is thereby avoided. Untimely and quick stresses of these motors and complex and relatively long calculations are avoided to determine incidence corrections to ensure permanently.

Of course, to ensure control of motors controlling the pinions 18 and 21 (and therefore the control of the positioning means 8), it is necessary to control the angular position in an absolute frame of the off-centering points C1 (for the cam 9) and C2 (for the disk 12). Another solution described below consists in controlling the angular position in an absolute frame of a first off-centering point and controlling the angular position of the other off-centering point in relation to the first maximum off-centering point.

As to the angular position of C1, it is easily obtained by the measure of the rotation angle of the motor driving the pinion 18, and therefore the cam 9. Thus, to know the angular position of the cam 9 in the absolute frame, it is possible to use an optical sensor fixed to the projectile body and rotating with it. The position of this sensor is exactly known with respect to the absolute frame provided by the inertial system of the projectile. The exact angular position of the maximum off-centering C1 of the cam 9 will be read by the sensor for example on an optical graduation O surrounding the shaft 10 (FIG. 9). The angular position of the cam 9 being thus known, the angular position of C2 can be obtained relative to the angular position of the cam 9, for example by a magnetic measure of the rotation of the disk 12 around the cam 9. To do so, a magnetic stripe B is positioned in the vicinity of the inner toothed ring gear 13 and a reading head C capable of reading this stripe B is fixed to the cam 9 and collects angular position information between the disk 12 and the cam 9. This angular information is transmitted to an embedded computer in charge of the servo-control and controls via conductor tracks P located on the primary shaft 10 and connected to the slider C. These tracks will be read for example by an inductive sensor or brushes. These means are exemplary illustrated in FIG. 9.

Various alternate embodiments are possible without departing from the scope of the invention. In particular, it is possible to define a device controlling a number of fins other than four, for example three fins or five or six fins. Only the number of arms of the ring 5 will then have to be modified. All other control means will remain unchanged.

It is also possible to define a device in which movements of the orientation ring 5 are controlled by positioning means 8 with a different structure.

Figure 13:
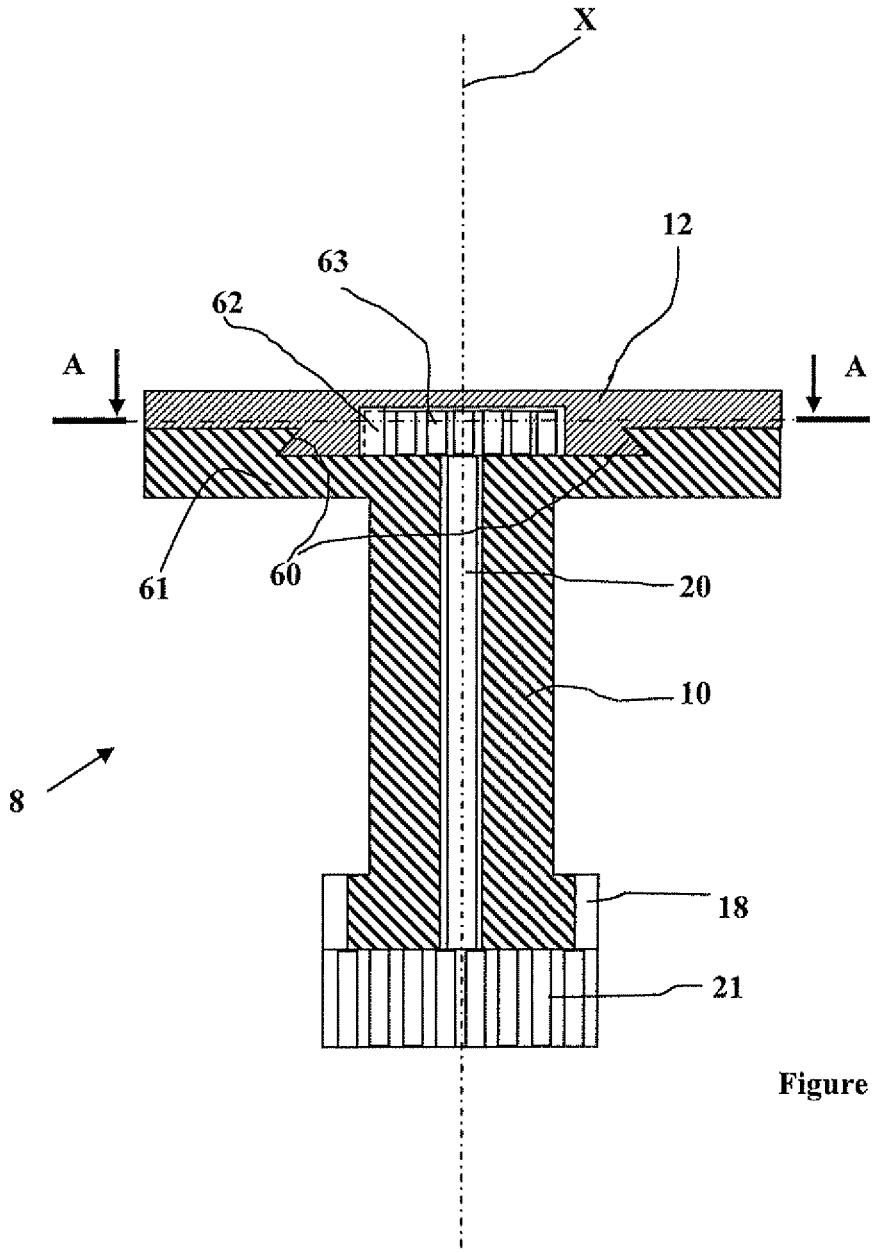
FIG. 13 shows a longitudinal section view of positioning means according to an alternate embodiment of the invention.

Thus, according to FIG. 13, the positioning means 8 comprises a disk 12 for cooperating with the bore 5*c* of the ring 5 previously described. The ring 5 is not shown on this figure but the structural features thereof and its cooperation with the fins are identical to what was previously described in reference to FIGS. 2 and 3.

According to the invention, the positioning of the ring 5 in a plan perpendicular to the longitudinal axis of the projectile will enable to control the fins. This positioning of the ring 5, so of the centre 5*b* thereof, is ensured by the control of the movement of the disk 12 which is coaxial with the ring 5 and around which this ring will rotate.

The disk 12 comprises a slide linkage 60 corresponding to a plate 61 fixed to the primary shaft 10. The slide linkage may be for example of the dovetail-type. As can be better seen in FIG. 14, the slide linkage 60 is oriented parallel to a diameter of the disk 12. The disk 12 comprises further a rack 62 oriented parallel to the slide linkage 60. The primary shaft 10 is coaxial with the rolling axis X of the projectile, it is fixed to the plate 61 by one of its ends and comprises a primary pinion 18 at the second end thereof, said pinion, as in the previous embodiment, meshing with a motorization (not shown).

A secondary shaft 20 is arranged coaxially with this primary shaft 10, the secondary shaft 20 comprising a pinion (63 or 21) at each of its ends. The pinion 21 is driven, as in the previous embodiment, by a motorization (not shown). The pinion 63 meshes with the rack 62.

Figure 14:
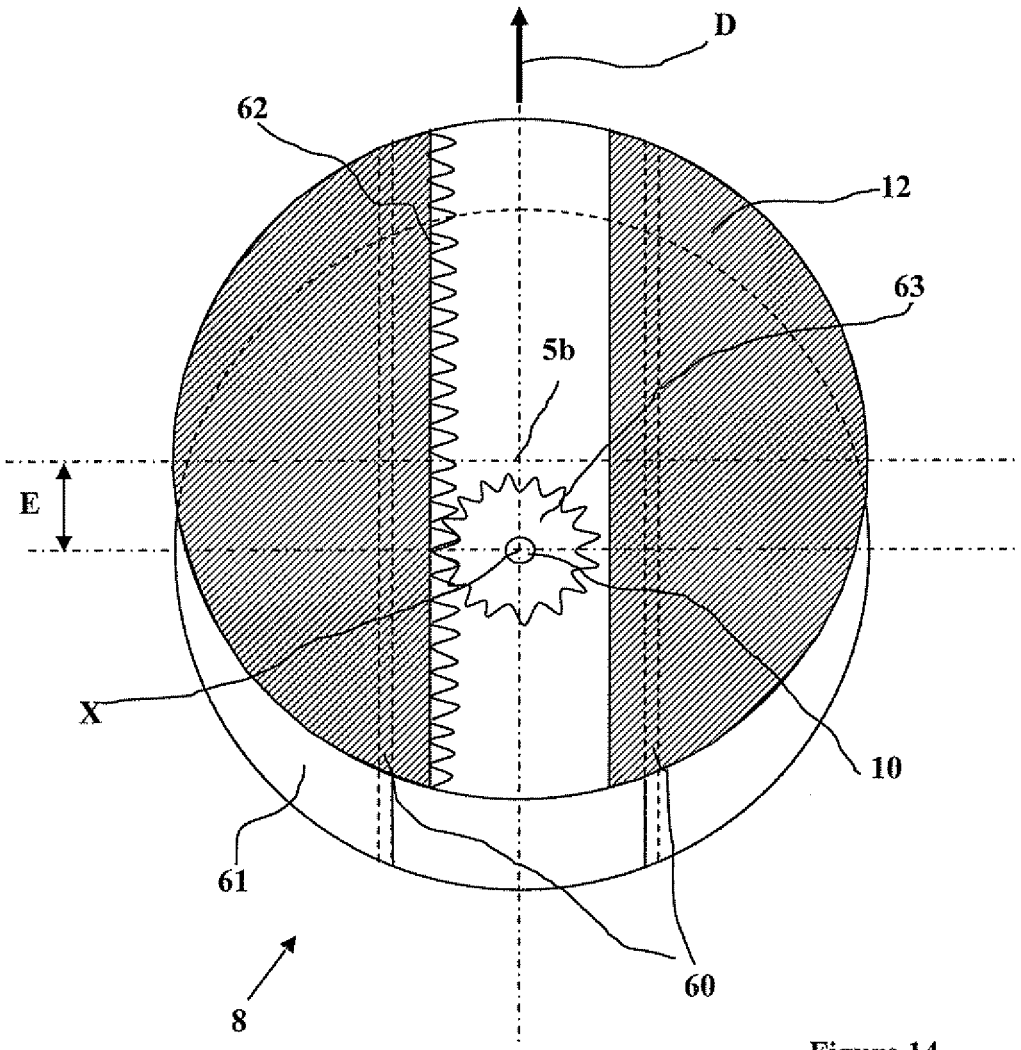
FIG. 14 shows a cross-section view A-A of the positioning means of FIG. 13, the line of plan AA being identified in FIG. 13.

According to FIG. 14, to move the disk 12 in the plan P, a rotation of the primary shaft 10 will first be performed so as to position the slide 60 parallel to the desired direction D for a given trajectory correction, and then a rotation of the secondary shaft 20 will be performed to move the rack 62.

The rotation of the primary 10 and secondary 20 shafts will be performed by electrical motors.

In a first phase, the rotation speed $\Omega$ of the projectile is compensated by rotating the primary shaft 10 and the secondary shaft 20 together by an angle $-\Omega$ (as in the previous embodiment). This enables to fix the position of the device 8 and thus of the rack 62 in the absolute frame so as to maintain the disk 12 coaxial with the plate 61 and the rolling axis X of the projectile. This position of the disk 12 corresponding to a neutral position of the fins (without incidence). It can be noted that, if the primary shaft and the secondary shaft rotate together with the projectile and if the disk is centered, then the fins are all at the same neutral and the projectile trajectory is not affected. This first immobilization phase of the positioning means in the absolute frame provides an angular reference for the following phases.

In a second phase, a trajectory correction following a direction D must be controlled. The rotation of the primary shaft 10 is then controlled to position the rack 62 parallel to the direction D of the desired trajectory correction. In order for the disk 12 to remain coaxial with X during the rack orientation, the orientation operation of the rack 62 should provoke at the secondary shaft 20 a compensation of the rotation of the rack 62 around X. Therefore, for a rotation of the plate 61 by an angle Φ, the secondary shaft 20 should rotate simultaneously by the same value and in the same direction.

Finally, in a third phase, the secondary shaft 20 is controlled to move the rack 62 in the desired direction D (FIG. 14). The disk 12 is thereby off-centered by a value E with respect to the rolling axis X. The disk 12 being surrounded by the ring 5 (not shown in FIGS. 13 and 14) causes the sliding of the ring 5 in the plan P, acting thereby on the inclination of the fins of the projectile.

Of course, to ensure the control of the motors controlling the pinions 18 and 21 (thus the control of the positioning means 8), it is necessary to control the angular position in an absolute frame of the rack 62 as well as the amplitude (E) of the movement of this rack.

The angular position is easily obtained as in the previous embodiment by optical measure sensors of the rotation of the motors driving these pinions. The position of the rack 62 in relation to the plate 61 is obtained using for example a sensor fixed to the plate 61 and reading the position of marks performed on the disk 12 (for example teeth of the rack 62).

The invention claimed is:

1. A projectile with incidence steerable fins comprising at least three incidence steerable fins, each of the at least three incidence steerable fins being rotatable with respect to the projectile around a pivot axis perpendicular to a longitudinal axis X of the projectile, the projectile comprising:

a fin orientation ring, the ring comprising as many arms as there are fins, wherein the ring can translate in a plane P perpendicular to the longitudinal axis X of the projectile and following at least two directions of this plane P, wherein the fin orientation ring can rotate around a centre of the fin orientation ring parallel to the longitudinal axis X of the projectile, each arm comprising means cooperating with an orientation lever fixed to a fin to be able to cause a rotation of the fin around the rotation axis of the fin during movement of the ring, the translation of the ring being ensured by positioning means of the centre of the fin orientation ring in the plane P with respect to an absolute frame centered on the longitudinal axis of the projectile, and wherein the positioning means comprises a disk positioned in a central bore of the ring and comprising a circular opening off-centered with respect to a centre of the disk to move the centre of the fin orientation ring by rotation of the disk.

2. The projectile with incidence steerable fins according to claim 1, wherein the positioning means of the centre of the fin orientation ring in both directions of the plane P comprises a cam cooperating with the off-centered circular opening of the disk, the off-centered circular opening comprising an inner toothed ring gear meshing with a pinion centered on the longitudinal axis of the projectile, the combined rotations of the pinion and of the cam enabling the movement of the disk.

3. A method of controlling fins of a projectile according to claim 2 for orientating the projectile according to a given direction D transverse to the projectile, wherein the method comprises successively the following steps:

rotating the positioning means in a direction opposite to the rolling of the projectile so as to compensate the rotation of the projectile, pivoting the cam and the disk so that respective maximum off-centering points of the cam and the disk C1, C2 are diametrically opposite and an alignment A formed by the off-centering points of the cam and the disk C1, C2 is perpendicular to the direction D, and pivoting simultaneously and in opposite directions the disk and the cam by a same angular value so as to bring each of the off-centering points of the cam and the disk C1, C2 closer to the direction D, thereby moving the centre of the fin orientation ring in a corresponding direction and according to a corresponding movement amplitude.

* * * * *